US005995067A

United States Patent [19]

Terasawa et al.

[11] Patent Number: 5,995,067

[45] Date of Patent: Nov. 30, 1999

[54] INK JET RECORDING APPARATUS WHICH CONTROLS RECOVERY OPERATION IN ACCORDANCE WITH ENVIRONMENTAL CONDITIONS

[75] Inventors: Koji Terasawa, Mitaka; Sanko Yamaguchi, Kawasaki, both of Japan

[73] Assignee: Canon Kabushiki Kaisha, Tokyo, Japan

[21] Appl. No.: 08/980,207

[22] Filed: Nov. 28, 1997

Related U.S. Application Data

[63] Continuation of application No. 08/214,119, Mar. 17, 1994, abandoned.

[30] Foreign Application Priority Data

Mar. 19, 1993 [JP] Japan ..... 5-060445

[51] Int. Cl.[6] ..... B41J 2/165; B41J 29/38

[52] U.S. Cl. ..... 345/23; 347/14; 347/30

[58] Field of Search ..... 347/23, 30, 35, 347/19, 17, 60, 14

[56] References Cited

U.S. PATENT DOCUMENTS

| | | | |
|---|---|---|---|
| 4,176,363 | 11/1979 | Kasahara | 346/140 R |
| 4,692,777 | 9/1987 | Hasumi | 346/140 R |
| 4,970,527 | 11/1990 | Gatten | 347/23 |
| 5,428,379 | 6/1995 | Kaneko et al. | 347/23 |
| 5,572,242 | 11/1996 | Fujii et al. | 347/23 |

FOREIGN PATENT DOCUMENTS

| | | | |
|---|---|---|---|
| 3252748 | 10/1988 | Japan | 347/23 |
| 3260450 | 10/1988 | Japan | 347/23 |
| 2-3324 | 1/1990 | Japan | 347/23 |
| 5338134 | 12/1993 | Japan | 347/23 |

*Primary Examiner*—John Barlow
*Assistant Examiner*—Craig A. Hallacher
*Attorney, Agent, or Firm*—Fitzpatrick, Cella, Harper & Scinto

[57] ABSTRACT

An ink jet recording apparatus detects the temperature and humidity of the environment in which the ink jet recording apparatus is used when the power-supply is turned on, and checks the detected levels. If the detected levels are lower than the predetermined levels, no ink exhaust is executed as uniquely set, but the number of predischarges is set in accordance with the detected levels. Hence the recording apparatus rises. Also, the standby time of the recording apparatus is measured, and after the recording apparatus rises, the recovery mode is automatically selected in accordance with the temperature, humidity, and standby time. Also, depending on the conditions, the predischarges are executed in the number of discharges which has been changed, thus making it possible to reduce the ink consumption for the operations other than printing, and implement shortening the time required for the recovery operation.

20 Claims, 4 Drawing Sheets

INK JET RECORDING APPARATUS WHICH CONTROLS RECOVERY OPERATION IN ACCORDANCE WITH ENVIRONMENTAL CONDITIONS

This application is a continuation of application Ser. No. 08/214,119 filed Mar. 17, 1994 abandon.

BACKGROUND OF THE INVENTION

1. Field of the Invention

The present invention relates to an ink jet recording apparatus. More particularly, the invention relates to an ink jet recording apparatus having a discharge recovery mechanism for the recording head of an ink jet recording apparatus, and a sensor to detect the environmental conditions in which the ink jet recording apparatus is used.

2. Related Background Art

An ink jet recording apparatus having a discharge recovery mechanism for automatic recovery operations has hitherto been structured to set the conditions of the discharge recovery operation in such a manner that even in a usual use, the period during which the recording apparatus is not in use tends to be set longer than necessary or the environmental conditions of use are set in a wider range, and that the removal of air bubbles for a stabilized discharge, and the exhaust of overly viscous ink from the nozzles by exerting pressure or suction. Also, when the power-supply is turned on, a greater recovery operation is executed than that for the usual use by exhausting ink from the nozzles automatically, among other means.

However, the conventional example described above has the following drawbacks:

(1) Since a single discharge recovery operation is set for the stabilized discharge, ink is automatically exhausted from the nozzles even in an event that the power-supply of the recording apparatus is frequently turned on and off. Hence a considerable amount of ink is wasted.

(2) Also, the discharge recovery operation is set for a longer period in anticipation of securing a stabilized discharge when the power-supply is turned on irrespective of the environmental conditions in which the ink jet recording apparatus is used. As a result, it takes a longer time for the recording apparatus to rise after the power-supply is turned on.

SUMMARY OF THE INVENTION

It is an object of the present invention to provide an ink jet apparatus whose ink consumption for the operations other than printing is small, and which makes it possible to shorten its rising time in accordance with the environmental conditions of use when the power-supply is turned on.

An ink Jet recording apparatus according to the present invention is characterized in that the automatic execution of the discharge recovery operation by its discharge recovery mechanism is varied in accordance with the detected environmental conditions of use.

The ink jet recording apparatus of the present invention comprises:

discharge recovery means for recovering the discharge state of the recording head by discharging ink from the recording head; detection means for detecting the environmental conditions of the ink jet recording apparatus; and recovery control means for controlling the recovery conditions of the discharge recovery means in accordance with the result of detection by the detection means when the ink jet recording apparatus rises.

Also, the ink jet recording apparatus of the present invention comprises:

discharge recovery means for recovering the discharge state of the recording head;

ink exhaust means for exhausting ink from the recording head by suction and/or pressure;

detection means for detecting the environmental conditions of the ink jet recording apparatus; and recovery control means for selecting and executing a recovery operation of the ink exhaust means and/or the discharge recovery means in accordance with the result of detection by the detection means, and at the same time, controlling the recovery conditions of the discharge recovery means.

Also, the ink jet recording apparatus of the present invention comprises:

head recovery means for recovering the state of ink discharge of the recording head;

detection means for detecting the environmental conditions of the ink jet recording apparatus;

timer means for measuring the standby time of the ink jet recording apparatus; and recovery control means for controlling the recovery conditions of the head recovery means in accordance with the result of detection by the detection means and the result of measurement by the timer means.

Also, the head recovery means comprises discharge recovery means for recovering the discharging state of the recording head by discharging ink from the recording head, and ink exhaust means for exhausting ink from the recording head by suction and/or pressure.

The recovery control means selects and executes a recovery operation of the ink exhaust means and/or the discharge recovery means in accordance with the result of detection by the detection means and the result of time measurement by the timer means, and at the same time, controls the number of ink discharges of the discharge recovery means.

Further, the recovery control means executes the recovery operation of the recording head by the ink exhaust means when the detected levels of temperature and humidity by the detection means are lower than predetermined levels, respectively, and the time measured by the timer means is a predetermined time.

Also, the method for ink jet recording according to the present invention comprises the following steps of:

detecting the temperature and humidity as the environmental conditions of an ink jet recording apparatus;

measuring the standby time of the ink jet recording apparatus;

recovering the discharge to recover the discharge state of the recording head by discharging ink from the recording head in accordance with the result of detection in the detection step and the result of measurement in the time measurement step; and selecting and executing a recovery operation in the ink exhaust step of exhausting ink from the recording head by suction and/or pressure, and at the same time, recovering the state of the recording head by controlling the number of ink discharges in the discharge recovery step.

Also, the recovery step is to execute the recovery operation of the recording head in the ink exhaust step when the detected levels of temperature and humidity in the detection step are lower than the predetermined levels, respectively, and the time measured in the time measurement step is a predetermined time.

The present invention is to automatically select by use of a temperature sensor, a humidity sensor, and others, a preferable mode of discharge recovery according to the environmental conditions of an ink jet recording apparatus by detecting such conditions. In this way, the discharge mode is not necessarily set only uniquely, hence making it possible to reduce the consumption of ink to be exhausted from the nozzles, but its discharges are still kept stabilized, and also reduce the number of predischarges required, among others, thus making the rising time of the recording apparatus shorter than that conventionally required when the power-supply is turned on.

BRIEF DESCRIPTION OF THE DRAWINGS

FIG. 2 is a flowchart showing the operation of the ink jet recording apparatus shown in FIG. 1 when the power-supply is turned on.

DETAILED DESCRIPTION OF THE PREFERRED EMBODIMENTS

Hereinafter, with reference to the accompanying drawings, the description will be made of the embodiments according to the present invention.

Figure 1:
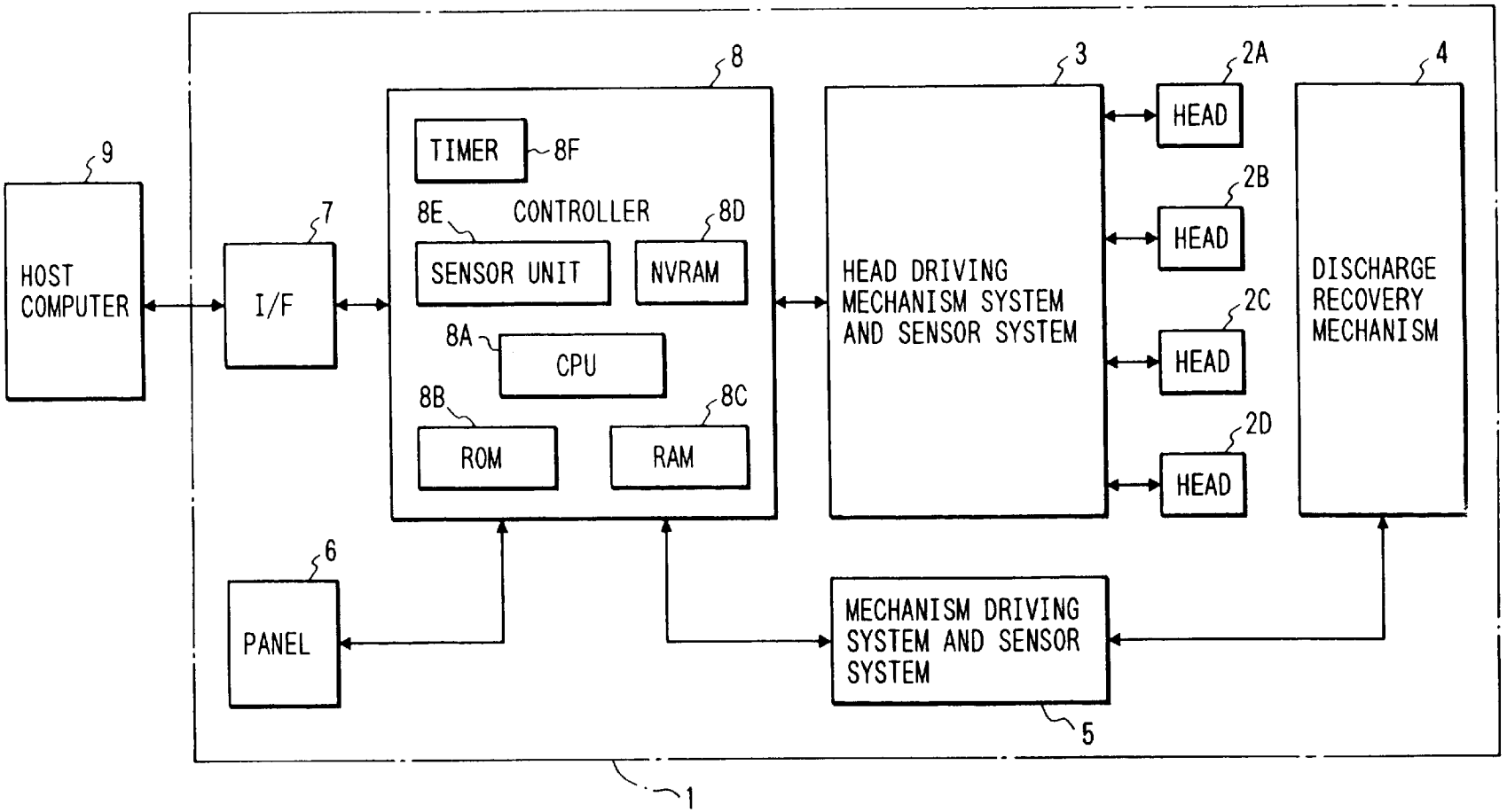
FIG. 1 is a block diagram showing one embodiment of an ink jet recording apparatus according to the present invention.
Figure 2:
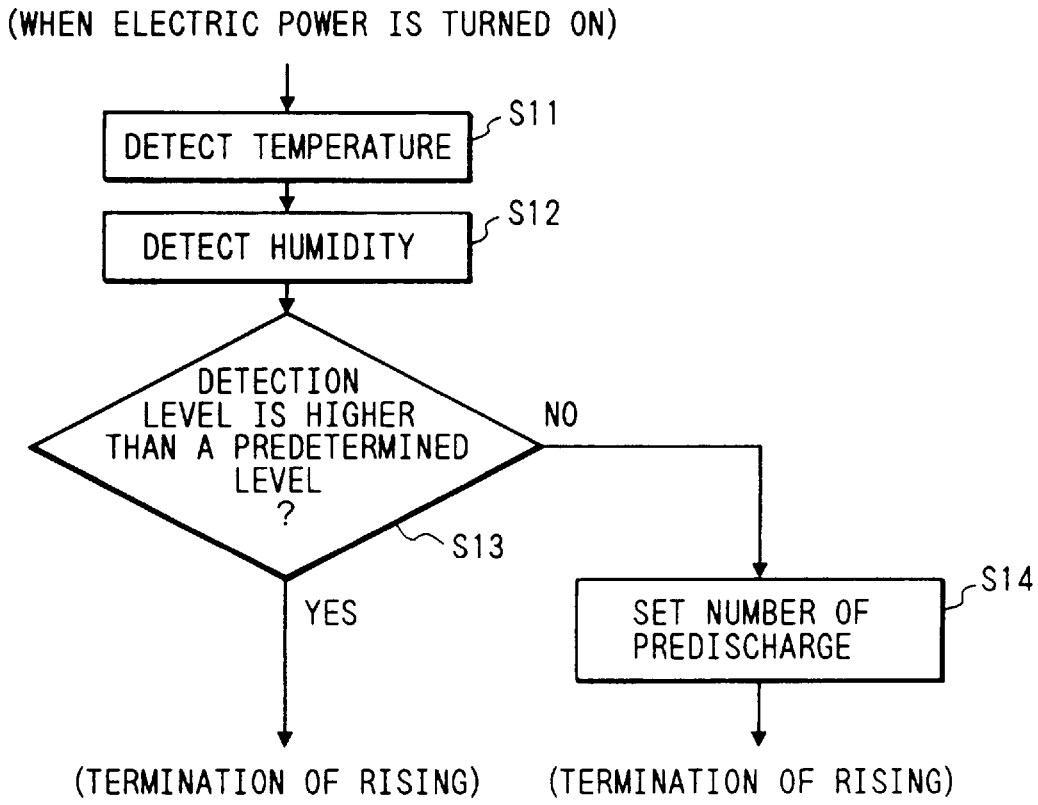

FIG. 1 is a block diagram showing an embodiment of an ink jet recording apparatus according to the present invention. FIG. 2 is a flowchart showing the process of a controller 8 when the power-supply is turned on.

An ink jet recording apparatus 1 described in the present embodiment is a color ink jet printer having a plurality of heads to discharge different colors of ink for recording, respectively, and comprises the heads 2A, 2B, 2C, and 2D (each corresponding to Bk, C, M, and Y, respectively); head driving system and sensor system 3 to drive the heads 2A to 2D; a discharge recovery mechanism 4; mechanism driving system and sensor system 5 to drive the discharge recovery mechanism 4; a panel 6; an interface (I/F) 7 connected to a host 9; and the controller 8.

The controller 8 comprises a CPU 8A, a ROM 8B, a RAM 8C, an NVRAM 8D, a sensor unit 8E, and a timer 8F. For the sensor unit 8E, there are arranged the thermosensitive element (thermistor) and humidity sensor, which detect the temperature and humidity of the environment in which the ink jet recording apparatus 1 is used. As the humidity sensor, the sensors of a variable resistance type, and a static capacitance detection type can be used, among others. In the ROM 8B, a plurality of sequences are stored for stabilizing discharge when the power-supply is turned on. To the NVRAM 8D, the CPU 8A automatically writes the temperature and humidity, which are detected by the sensor unit 8E and A/D converted by a circuit (not shown), in accordance with the reading levels set in plural stages in advance.

FIG. 2 is a flowchart for setting the recovery conditions for the ink jet recording apparatus when the power-supply is turned on.

According to the present embodiment, when the power-supply is turned on, the sensor unit 8E detects the temperature and humidity of the environment in which to use the ink jet recording apparatus 1 (step S11 and step S12) as shown in FIG. 2; check the detected levels (step S13); and if the detected levels are lower than the predetermined levels, the ink exhaust, which has been set uniquely, is not executed, but the number of predischarges is set (S14) in accordance with the detected levels. In this way, the recording apparatus 1 rises.

If the levels detected in the step S13 are higher than the predetermined levels, the uniquely set ink exhaust is executed. Also, if the detected levels are higher than the predetermined levels, it may be possible to set the predischarge in accordance with the detected levels. Also, the forcible exhaust of ink from nozzles may be set as a recovery condition if the detected levels are lower than the predetermined levels.

Figure 3:
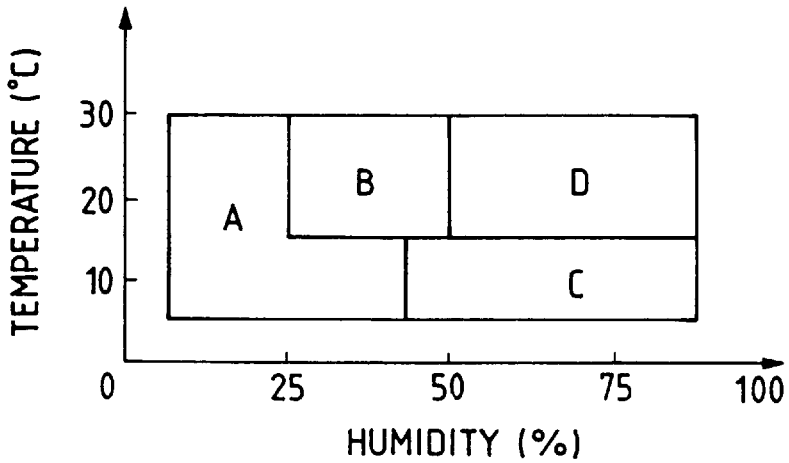
FIG. 3 is a view showing an example of setting mode for a discharge stabilization when combining the detected levels under the environment of a general use.

FIG. 3 shows a second embodiment according to the present invention, and is a view showing the relationship between the combination of the levels of temperature and humidity levels in the environment of a general use, and the mode of discharge stabilization.

The area A is a low humidity area and a part of low temperature section. There is a need for forcibly exhausting the overly viscous ink from the nozzles automatically. The discharge recovery mechanism 4 is required to operate for the suction and pressurized exhaust of ink. The areas B, C, and D are those for which the number of predischarges are varied in three stages at the time of power-supply being turned on. Also, the number of predischarges for the area D is naturally the smallest. For the areas B and C, the number of predischarges becomes variable if the component of ink is such that its viscosity tends to be lowered by temperature or it has deliquescence because in these areas the temperature dependency is greater.

FIG. 3 is a schematic view, but the area in which the physical properties of ink change greatly is the one having the temperature at approximately 15° C. and humidity in 40 to 50%. Further, in a severer environment, it is necessary to determine the mode for stabilizing discharge separately.

The area in which the physical properties of ink changes greatly depends on the composition of the ink (material, mixture ration, and others). The detection levels for setting the recovery conditions should be defined differently in accordance with the kinds of ink.

Figure 4:
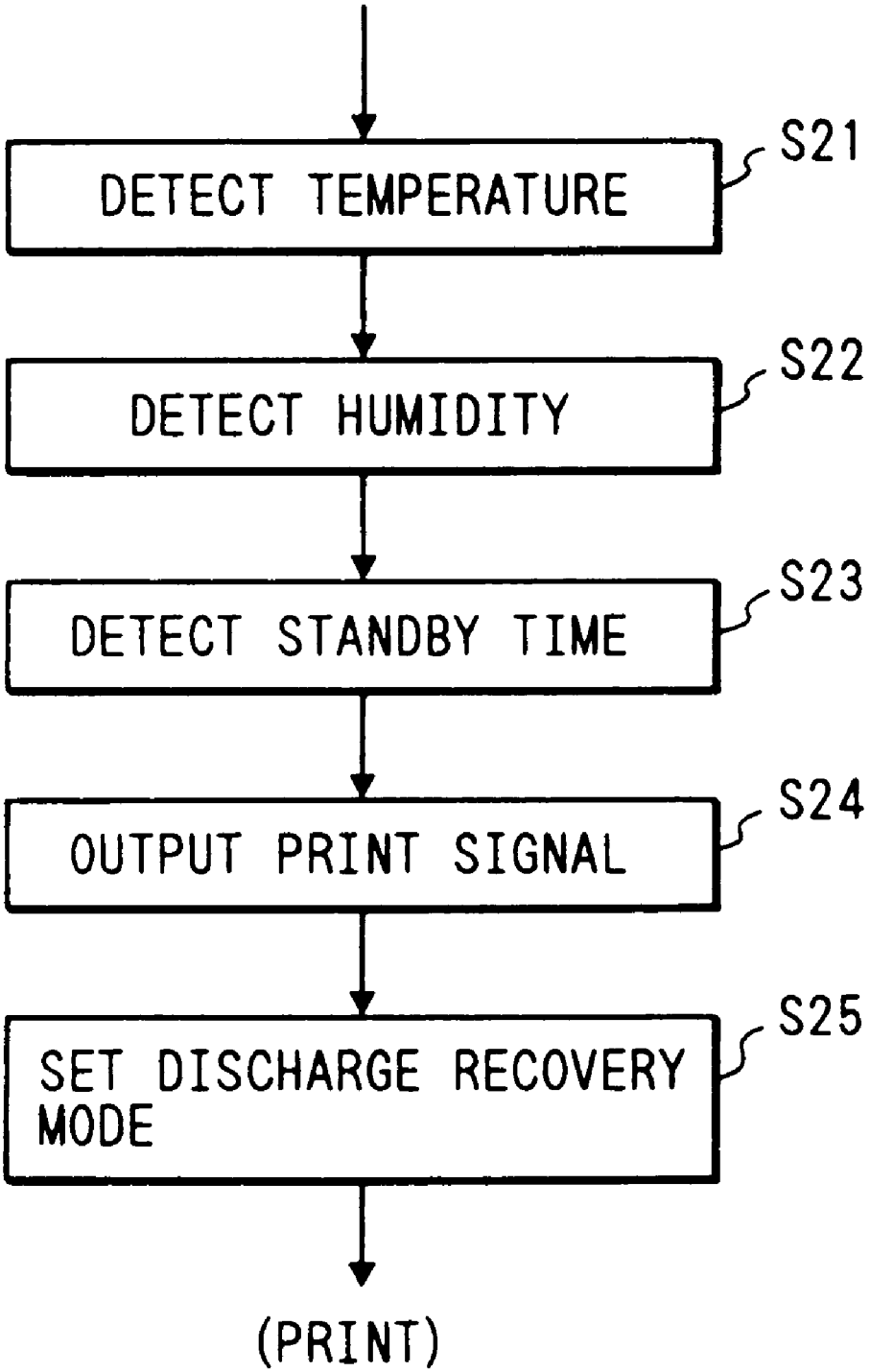
FIG. 4 is a flowchart showing another embodiment according to the present invention.

FIG. 4 is a flowchart showing a third embodiment according to the present invention.

According to the present embodiment, if the standby state remains in a long period of time after the power-supply is turned on, the mode for setting the discharge recovery is such that at first, in steps S21 and S22, the temperature and humidity in the recording apparatus are detected, and then, in step S23, the timer 8F of the controller 8 is started, thus beginning detection of the standby time. In the next step S24, if a printing signal is received, the discharge recovery mode is set in step S25 in accordance with the time of the timer 8F at that time, that is, the standby time, as well as the detected temperature and humidity.

In this case, too, it may be possible to set the recovery conditions on the basis of the example shown in FIG. 3.

As described above, by setting the discharge recovery mode in this way, the discharge recoveries can be executed appropriately in accordance with the environmental conditions, and also, the stability of the discharge can be enhanced, and the time required for executing the recovery process is shortened.

Figure 5:
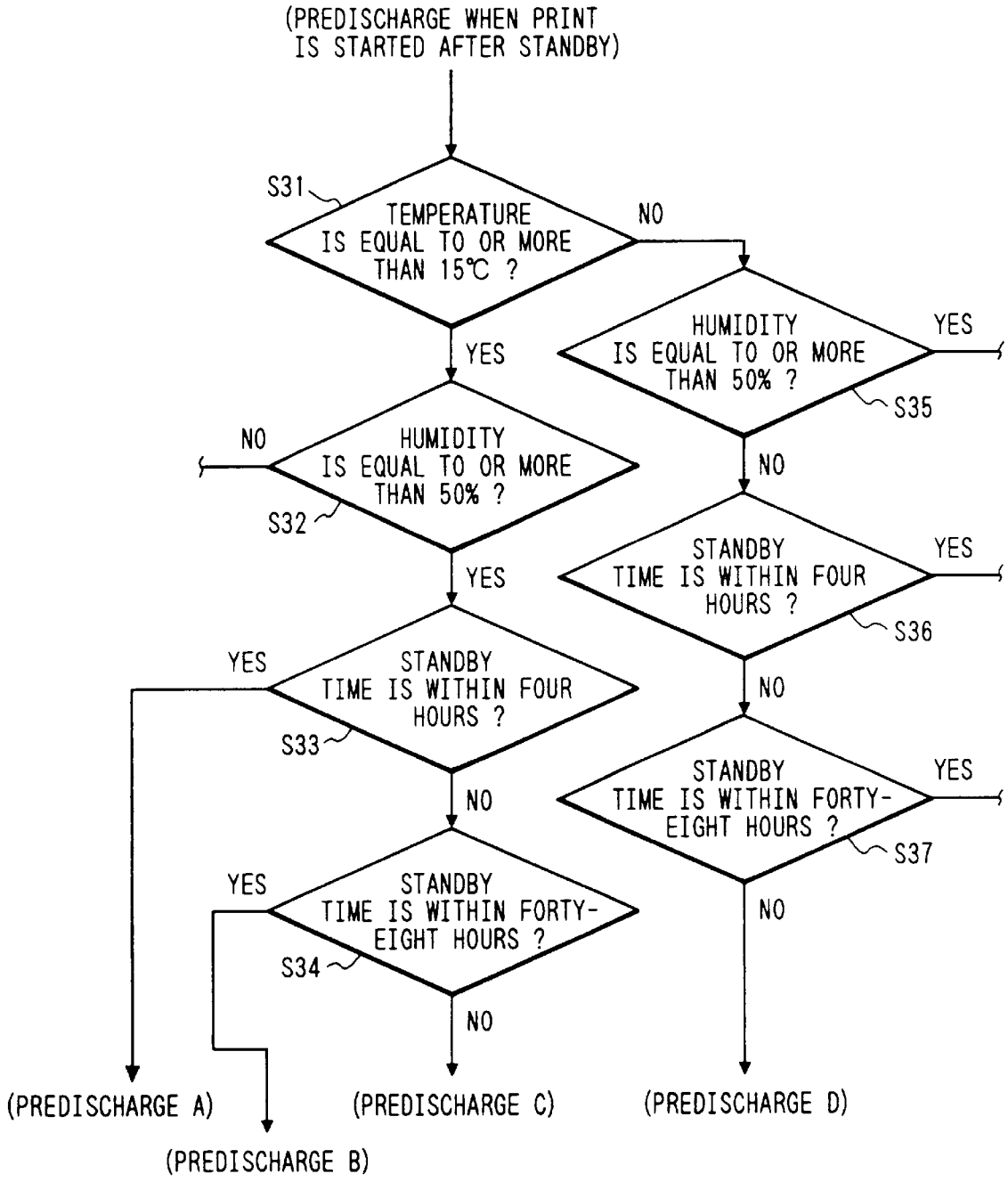
FIG. 5 is a flowchart showing still another embodiment according to the present invention.

FIG. 5 is a flowchart showing a fourth embodiment according to the present invention. The present embodiment is to make the discharge recovery mode in the third embodiment more precisely than has been described earlier.

The temperature is divided into two stages at around 15° C. while the humidity is divided into two stages in 40 to 50%. The standby time is divided into three stages, within 4 hours, 4 to 48 hours, and more than 48 hours. Then, in accordance with the conditions to be compared in step S31 to step S37, the number of discharges are set for several stages, that is, 50, 500, 1,000, 5,000 predischarges according to each of the combinations. Also, for the environmental conditions for the head, if the conditions that may present any problems are encountered, such as a low humidity (less than 50%), a low temperature (less than 15° C.), and a standby time of more than 48 hours, it is arranged that the discharge recovery mechanism 4 executes the suction operation to forcibly exhaust the overly viscous ink from the nozzles as shown in step S35 to step S37. Since the amount of ink consumed by the forcible exhaust of ink by the suction is greater than the ink consumption by the maximum number of predischarges, the ink consumption per nozzle per exhaust becomes several times more or in some cases, it is more than ten times. According to the present embodiment, however, it is possible to widen the area for which the predischarges will be just enough for the mode of discharge recovery when the power-supply is turned on. Thus the rising time of the recording apparatus 1 can be shortened accordingly.

As described above, according to the present invention, it is possible to reduce the ink consumption for the operations other than printing by automatically selecting the discharge recovery mode in accordance with the environmental conditions in which the ink jet recording apparatus is used or by combining such conditions with the standby time of the recording apparatus, and also, it is possible to effectively shorten the rising time of the recording apparatus in accordance with the conditions of us when the power-supply is turned on.

What is claimed is:

1. An ink jet recording apparatus for recording by discharging ink from a recording head, comprising:

discharge recovery means for recovering a discharge state of the recording head by discharging ink from said recording head;

detection means for detecting environmental conditions of the ink jet recording apparatus;

print signal detecting means for detecting an input of a print signal exhibiting a command for printing;

timer means for counting a lapse time from a time at which an electrical power source for the apparatus is turned on to the detection of the input of the print signal; and recovery control means for controlling conditions of a recovery operation executed by said discharge recovery means in accordance with the input of the print signal, wherein said recovery control means changes an amount of ink discharge to be performed by said discharge recovery means in accordance with a detection result by said detection means and the lapse time counted by said timer means.

2. An ink jet recording apparatus according to claim 1, wherein the environmental conditions detected by said detection means are humidity and temperature, and said recovery control means controls the number of discharges of said discharge recovery means in accordance with levels of humidity and temperature detected by said detection means.

3. An ink jet recording apparatus according to claim 1, further comprising:

ink exhaust means for exhausting ink from said recording head by suction and/or pressure.

4. An ink jet recording apparatus according to claim 1, wherein the recording head has an electrothermal energy converting element for applying thermal energy to the ink and discharges the ink by applying thermal energy to the ink.

5. An ink jet recording apparatus for recording by discharging ink from a recording head, comprising:

discharge recovery means for recovering a discharge state of the recording head by discharging ink from said recording head;

ink exhaust means for exhausting ink from said recording head by suction and/or pressure;

detection means for detecting the environmental conditions of the ink jet recording apparatus;

print signal detecting means for detecting an input of a print signal exhibiting a command for printing;

timer means for counting a lapse time from a time at which an electrical power source for the apparatus is turned on to the detection of the input of the print signal;

a plurality of recovery operating modes for performing different operations of said discharge recovery means and said ink exhaust means; and recovery control means for selecting said recovery operating mode in accordance with a detection result by said detection means and the lapse time counted by said timer means, and for performing a recovery operation prior to printing by the command of the print signal.

6. An ink jet recording apparatus according to claim 5, wherein said recovery control means selects the recovery operating mode of said ink exhaust means and/or said discharge recovery means when the ink jet recording apparatus rises, and at the same time, controls operating conditions of said discharge recovery means.

7. An ink jet recording apparatus according to claim 5, wherein the environmental conditions detected by said detection means are humidity and temperature, and said recovery control means controls the recovery operation in accordance with levels of humidity and temperature detected by said detection means.

8. An ink jet recording apparatus according to claim 7, wherein said recovery control means controls the number of ink discharges of said discharge recovery means.

9. An ink jet recording apparatus according to claim 8, wherein said recovery control means further comprises means for comparing the detected levels of the temperature and the humidity with predetermined levels of the temperature and the humidity, and executes the recovery operation for said recording head by said ink exhaust means when the detected levels of the temperature and the humidity by said detection means are lower than the predetermined levels of the temperature and the humidity, respectively.

10. An ink jet recording apparatus according to claim 9, wherein said predetermined levels are the levels of detection at which the physical properties of ink change in said humidity and at said temperature, respectively.

11. An ink jet recording apparatus according to claim 5, wherein the recording head has an electrothermal energy converting element for applying thermal energy to the ink and discharges the ink by applying thermal energy to the ink.

12. A ink jet recording apparatus for recording by discharging ink from a recording head, comprising:

head recovery means for recovering a state of ink discharge of said recording head, said head recovery means including discharge recovery means for discharging ink from said recording head to recover the state of ink discharge of the recording head, and ink exhaust means for exhausting ink from said recording head by suction and/or pressure;

detection means for detecting environmental conditions of the ink jet recording apparatus;

print signal detecting means for detecting an input of a print signal exhibiting a command for printing;

timer means for counting a lapse time of said recording apparatus from a time at which an electrical power source for the apparatus is turned on until said print signal detecting means detects the input of the print signal; and recovery control means for controlling operating conditions of said head recovery means in accordance with a result detected by said detection means and a result of a time measurement by said timer means, wherein said recovery control means controls a number of ink discharges to be performed by said head recovery means and controls an amount of ink to be exhausted by said head recovery means, and said recovery control means selects a recovery operation of said ink exhaust means and/or said discharge recovery means in accordance with the result of detection by said detection means and the result of time measurement by said timer means, and at the same time, controls the number of discharges of said discharge recovery means.

13. An ink jet recording apparatus according to claim 12, wherein said recovery control means changes the number of discharge recoveries of said discharge recovery means in accordance with the result of detection by said detection means and the result of time measurement by said timer means.

14. An ink jet recording apparatus according to claim 12, wherein said recovery control means further comprises means for comparing the detected levels of the temperature and the humidity with predetermined levels of the temperature and the humidity, and executes the recovery operation of said exhaust means for said recording head when the detected levels of the temperature and humidity by said detection means are lower than predetermined levels of the temperature and the humidity, respectively.

15. An ink jet recording apparatus according to claim 15, wherein said predetermined levels are the levels of detection at which the physical properties of ink change in said humidity and at said temperature, respectively.

16. An ink jet recording apparatus according to claim 12, wherein said recovery control means further comprises means for comparing the detected levels of the temperature and the humidity with predetermined levels of the temperature and the humidity, and executes the recovery operation of said ink exhaust means for said recording head when the detected levels of the humidity and temperature by said detection means are lower than the predetermined levels of the humidity and the temperature, respectively, and the time counted by said timer means is the predetermined time.

17. An ink jet recording apparatus according to claim 12, wherein the recording head has an electrothermal energy converting element for applying thermal energy to the ink and discharges the ink by applying thermal energy to the ink.

18. A method for ink jet recording by discharging ink from a recording head, comprising the steps of:

detecting temperature and humidity as environmental conditions of an ink jet recording apparatus;

detecting an input of a print signal exhibiting a command for printing;

counting a lapse time of said recording apparatus from a time at which an electrical power source for the apparatus is turned on until the input of said print signal is detected at said detecting step;

recovering the discharge to recover a state of discharge of the recording head by discharging ink from said recording head in accordance with a result of detection in said detection step and a counting result in said time counting step; and selecting a recovery operation in the recovering step to exhaust ink from said recording head by suction and/or pressure, and at the same time, recovering the state of said recording head by controlling a number of ink discharges in said discharge recovering step.

19. A method for ink jet recording according to claim 18, wherein said recovery step further comprises a step of comparing levels of the temperature and humidity detected in said detecting step with predetermined levels of the temperature and the humidity, and a step of executing the recovery operation for said recording head when the detected levels of the temperature and humidity in said detection step are lower than the predetermined levels of the temperature and the humidity, respectively, and the time counted in said time counting step is the predetermined time.

20. An ink jet recording method according to claim 18, wherein the recording head has an electrothermal energy converting element for applying thermal energy to the ink and discharges the ink by applying thermal energy to the ink.

* * * * *

UNITED STATES PATENT AND TRADEMARK OFFICE

CERTIFICATE OF CORRECTION

PATENT NO. : 5,995,067

DATED : November 30, 1999

INVENTOR(S) : Terasawa et al.

It is certified that error appears in the above-identified patent and that said Letters Patent is hereby corrected as shown below:

ON THE TITLE PAGE:

Item [56] References Cited

"3252748" should read --63-252748--;
"3260450" should read --63-260450--; and
"5338134" should read --5-338134--.

COLUMN 1

Line 52, "Jet" should read --jet--.

COLUMN 7

Line 44, "claim 15" should read --claim 14--.

Signed and Sealed this

Twenty-third Day of January, 2001

*Attest:*

*Attesting Officer*

Q. TODD DICKINSON

*Commissioner of Patents and Trademarks*